US006233830B1

(12) United States Patent
Lamond et al.

(10) Patent No.: US 6,233,830 B1
(45) Date of Patent: May 22, 2001

(54) UTILITY KNIFE HANDLE

(75) Inventors: Donald R. Lamond, Lynbrook; Richard Andrew Whitehall, New York, both of NY (US); Adam Sanchez, Clifton, NJ (US)

(73) Assignee: General Housewares Corporation, Terre Haute, IN (US)

( * ) Notice: Subject to any disclaimer, the term of this patent is extended or adjusted under 35 U.S.C. 154(b) by 0 days.

(21) Appl. No.: 09/306,722

(22) Filed: May 7, 1999

(51) Int. Cl.[7] ..... B26B 1/04

(52) U.S. Cl. ..... 30/123; 30/125; 30/158; 30/160; 30/161; 30/340

(58) Field of Search ..... 30/125, 161, 160, 30/158, 162, 340, 123

(56) References Cited

U.S. PATENT DOCUMENTS

| | | | | |
|---|---|---|---|---|
| D. 347,563 | | 6/1994 | Okada . | |
| D. 349,227 | | 8/1994 | Ragland et al. . | |
| 2,948,961 | | 8/1960 | Ortner | 30/162 |
| 3,107,426 | | 10/1963 | Robinson, Jr. | 30/162 |
| 3,439,419 | | 4/1969 | Fleming | 30/162 |
| 3,577,637 | | 5/1971 | Braginetz . | |
| 3,872,591 | * | 3/1975 | Quenot | 30/162 |
| 3,888,002 | | 6/1975 | Graham . | |
| 4,005,525 | | 2/1977 | Gringer . | |
| 4,517,741 | | 5/1985 | Castelluzzo | 30/162 |
| 4,524,518 | | 6/1985 | West | 30/330 |
| 4,578,865 | | 4/1986 | Keller | 30/304 |
| 4,586,256 | | 5/1986 | Weimann | 30/162 |
| 4,604,805 | | 8/1986 | Krieger | 30/330 |
| 4,617,736 | | 10/1986 | McCrary | 30/169 |
| 4,621,425 | | 11/1986 | Stoutenberg . | |
| 4,622,070 | | 11/1986 | Sakurai et al. | 106/38.22 |
| 4,662,070 | * | 5/1987 | Reddig | 30/294 |
| 4,663,845 | | 5/1987 | Weimann | 30/162 |
| 4,683,656 | | 8/1987 | Peyrot et al. | 30/162 |
| 4,761,882 | | 8/1988 | Silverstein | 30/162 |
| 4,805,304 | | 2/1989 | Knoop | 30/162 |
| 4,825,552 | * | 5/1989 | Bendickson et al. | 30/342 |
| 4,835,865 | | 6/1989 | Knoop | 30/162 |
| 4,922,610 | * | 5/1990 | Szabo | 30/125 |
| 4,936,014 | | 6/1990 | Shaanan et al. | 30/162 |
| 4,939,839 | | 7/1990 | Gorst | 30/125 |

(List continued on next page.)

FOREIGN PATENT DOCUMENTS

WO99/00224 7/1999 (WO) ..... B26B/1/08

*Primary Examiner*—M. Rachuba
(74) *Attorney, Agent, or Firm*—McDermott, Will & Emery

(57) ABSTRACT

A utility knife handle including a housing with an interior cavity that houses a locking mechanism, a blade storage area, and a blade carriage mechanism. The locking mechanism includes a biased locking member that is slidably provided within a first housing portion and an engagement member provided on a second housing portion pivotally connected to the first housing portion. The housing has a closed position in which the locking member is engaged with the engagement member and an open position in which the locking member is slid out of engagement with the engagement member and the first and second housing portions are rotated to allow access to the interior cavity of the housing. The blade storage area includes a blade receiving portion with a magnet therein for holding stored blade within the blade storage area. The blade carriage mechanism has a blade carriage slidably disposed within the interior cavity of the housing and adjustable to a plurality of distinct locked positions. The blade carriage is configured to securely hold a blade. The blade carriage is biased towards a locked position, however, an actuator is provided exterior to the interior cavity that allows the user to place the blade carriage into an unlocked position whereby the blade carriage can be moved so that the blade extends through an opening in the housing.

26 Claims, 10 Drawing Sheets

U.S. PATENT DOCUMENTS

| | | | |
|---|---|---|---|
| 4,941,260 | 7/1990 | Castelluzzo | 30/162 |
| 4,953,293 | 9/1990 | Sterlacci | 30/124 |
| 5,012,581 | 5/1991 | Fletcher et al. | 30/162 |
| 5,022,156 | 6/1991 | Kallens et al. | 30/125 |
| 5,025,558 | 6/1991 | Gilbert | 30/162 |
| 5,031,322 | 7/1991 | Jacoff | 30/162 |
| 5,086,562 | 2/1992 | Jacoff | 30/162 |
| 5,093,994 | 3/1992 | Karas | 30/125 |
| 5,099,578 | 3/1992 | Jan | 30/162 |
| 5,203,085 | 4/1993 | Berns . | |
| 5,206,965 | 5/1993 | Rowley . | |
| 5,301,428 | 4/1994 | Wilcox . | |
| 5,490,331 | 2/1996 | Gold | 30/143 |
| 5,495,670 | 3/1996 | Quinn | 30/162 |
| 5,509,205 | 4/1996 | Ragland, III | 30/162 |
| 5,581,890 | 12/1996 | Schmidt | 30/162 |
| 5,613,300 | 3/1997 | Schmidt | 30/2 |
| 5,711,077 * | 1/1998 | Schulz et al. | 30/160 |
| 5,813,121 | 9/1998 | Gringer | 30/162 |
| 5,864,952 | 2/1999 | Chung | 30/162 |
| 5,878,501 | 3/1999 | Owens et al. | 30/286 |
| 5,924,203 | 7/1999 | Huang | 30/142 |
| 5,940,970 | 8/1999 | D'Ambro, Sr. et al. | 30/125 |
| 5,960,544 | 10/1999 | Beyers | 30/125 |
| 5,960,545 | 10/1999 | Shepherd et al. | 30/125 |
| 5,979,057 | 11/1999 | Chao | 30/125 |
| 6,044,562 | 4/2000 | Dillenbeck | 30/162 |

* cited by examiner

UTILITY KNIFE HANDLE

FIELD OF THE INVENTION

The present invention relates to hand tools, and in particular, to a utility knife handle.

BACKGROUND OF THE INVENTION

Utility knife handles have been constructed to hold razor blades for use during construction in order to provide and easy means for grasping the blade and manipulating the blade during use. Conventional utility knife handles provide a basic handle with some means for securing and removing the blades, such as a screw that can be used to loosen or tighten two halves of the handle. Many of the conventional utility knife handles are constructed without taking into account the comfort to the user or the easy of operation of the handle. For example, many handles require the use of a screwdriver or other tool in order to remove and replace a blade. Additionally, many conventional utility knife handles are not constructed to be ergonomically efficient or comfortable for the user to grasp and use. Many conventional utility knife handles are constructed having uniform housing dimensions that are sized for one particular size hand. Also, many conventional utility knife handles either do not provide a means for retracting the blade when it is not in use or they have retraction mechanisms that are difficult to use and ergonomically inefficient. And furthermore, many conventional utility knife handles do not provide for the storage of extra blades that is easily accessible and safe.

Consequently, a need exists for a utility knife handle that solves the aforementioned problems.

SUMMARY OF THE INVENTION

The present invention provides a utility knife handle that is safe, ergonomically efficient, and easy to use. The present invention achieves this result by providing a utility knife handle that has a housing with an interior cavity that houses a locking mechanism, a blade storage area, and a blade carriage mechanism.

The present invention advantageously provides a utility knife handle that has a housing with an interior cavity that houses a locking mechanism. The locking mechanism includes a biased locking member that is slidably provided within a first housing portion and an engagement member provided on a second housing portion pivotally connected to the first housing portion. The housing has a closed position in which the locking member is engaged with the engagement member and an open position in which the locking member is slid out of engagement with the engagement member and the first and second housing portions are rotated to allow access to the interior cavity of the housing. The locking mechanism can be easily actuated by the user without the need for additional tools, thereby allowing quick and convenient access to the interior of the housing.

The utility knife handle of the present invention additionally advantageously includes a blade storage area located within the interior cavity of the housing. The blade storage area includes a blade receiving portion with a magnet therein for holding stored blade within the blade storage area. The blade storage area provides an area for storing extra blades that can be quickly accessed and provides for easy removal of the extra blades.

The utility knife handle of the present invention further advantageously includes a blade carriage mechanism having a blade carriage slidably disposed within the interior cavity of the housing and adjustable to a plurality of distinct locked positions. The blade carriage is configured to securely hold a blade. The blade carriage is biased towards a locked position, however, an actuator is provided exterior to the interior cavity that allows the user to place the blade carriage into an unlocked position whereby the blade carriage can be moved so that the blade extends through an opening in the housing. Additionally, the actuator is offset from the center axis of the housing, thereby locating the actuator in an ergonomically efficient configuration by placing the actuator in a position where the user's thumb would naturally tend to be located when the user is comfortably grasping the housing.

Additional advantages and other features of the invention will be set forth in part in the description which follows and in part will become apparent to those having ordinary skill in the art upon examination of the following or may be learned from the practice of the invention. The advantages of the invention may be realized and obtained as particularly pointed out in the appended claims.

DETAILED DESCRIPTION OF THE PREFERRED EMBODIMENTS

Figure 1:
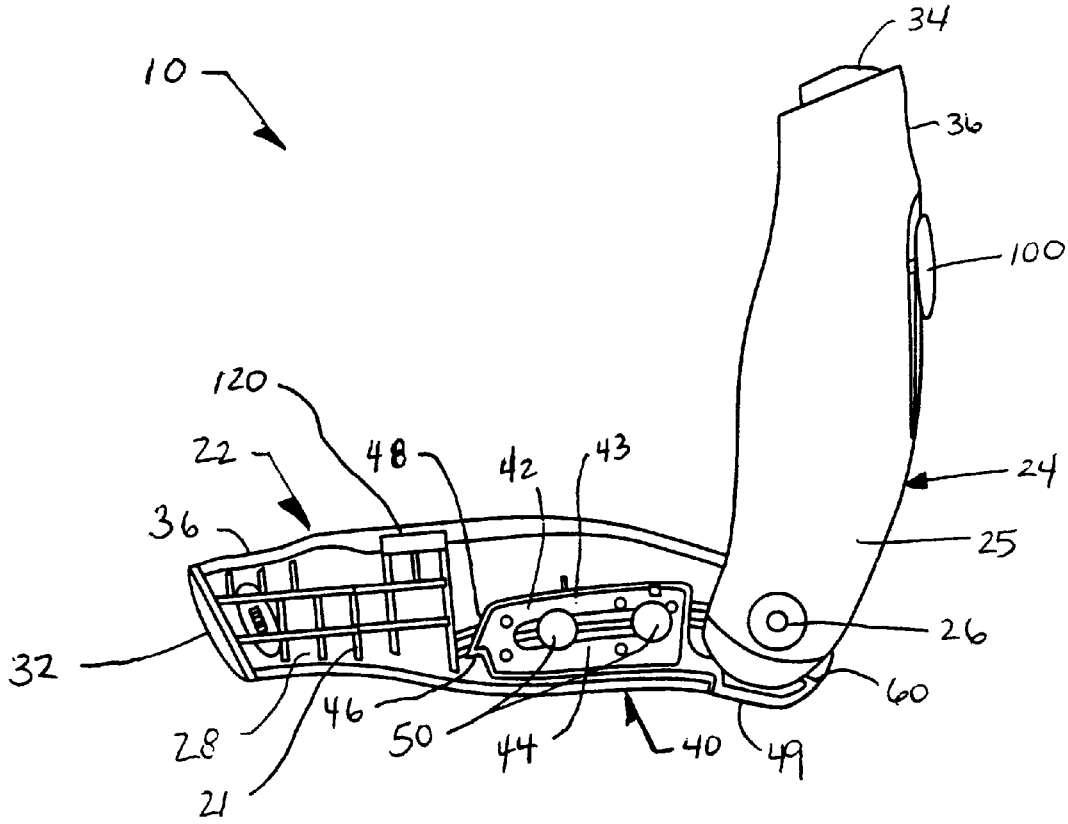
FIG. 1 is a right side view of an exemplary embodiment of a utility knife handle according to the present invention with the handle in an open position revealing a portion of a locking mechanism.
Figure 2A:
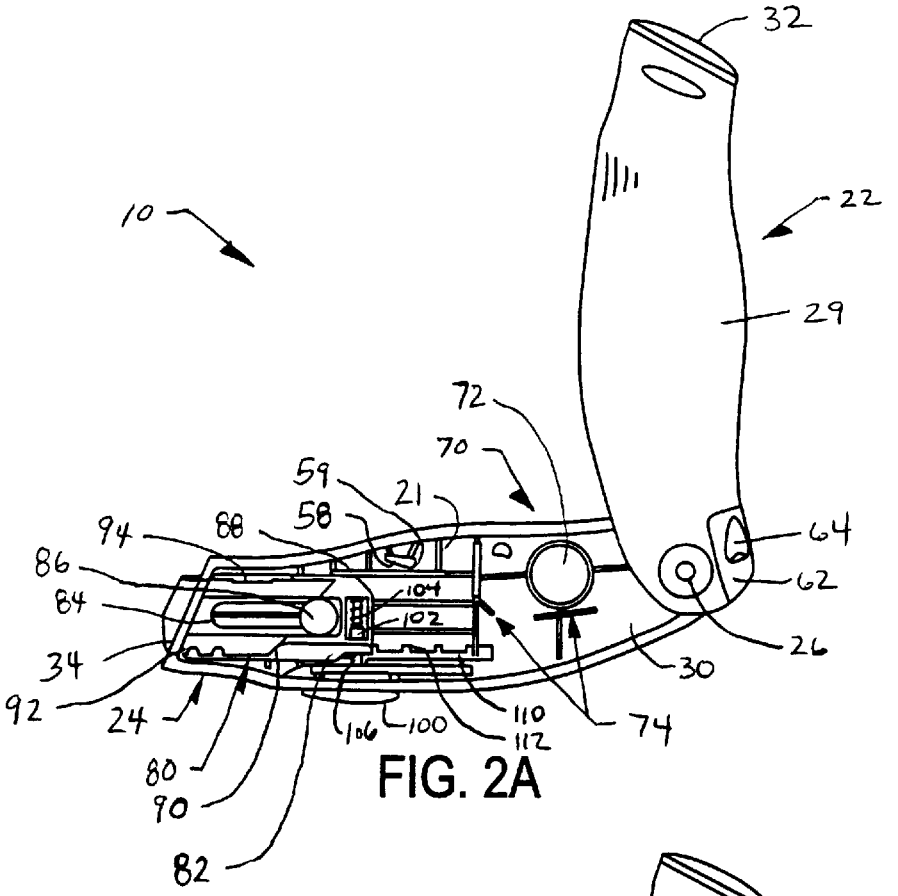
FIG. 2A is a left side view of the exemplary embodiment of a utility knife handle with the handle in the open position revealing a portion of a blade storage area and a portion of a blade carriage mechanism.
Figure 2B:
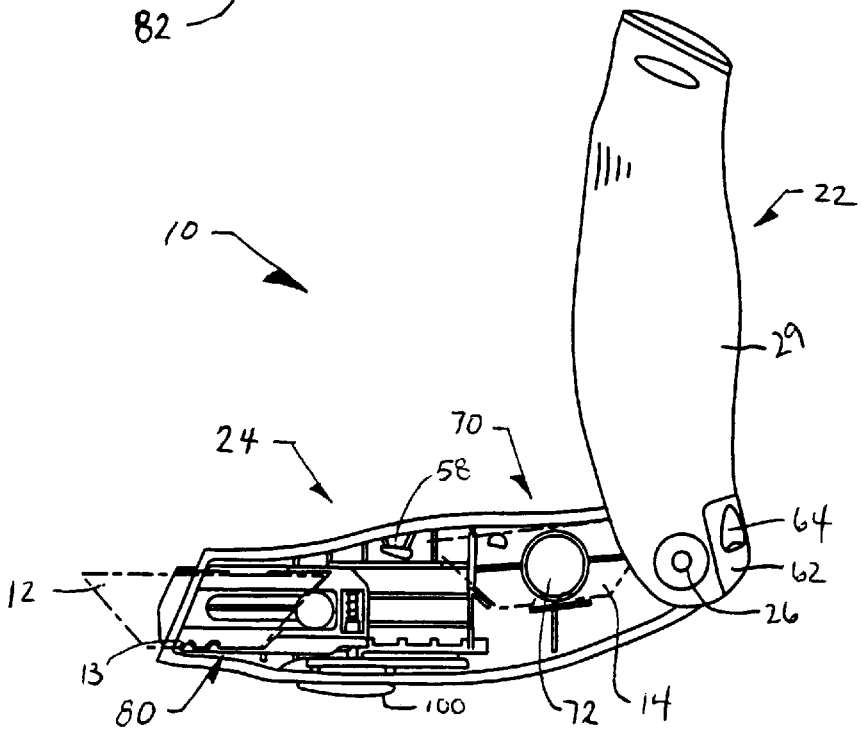
FIG. 2B is a left side view of the exemplary embodiment of a utility knife handle with the handle in the open position with a blade depicted in phantom lines in the blade storage area and in the blade carriage mechanism.

The present invention provides a utility knife handle 10 that includes a locking mechanism 40, a blade storage area 70, and a carriage mechanism 80. FIGS. 1–14 depict an exemplary preferred embodiment of a utility knife handle 10.

The exemplary embodiment of the utility knife handle 10 has a housing 20 that includes a first housing portion 22 connected to a second housing portion 24. The first housing portion 22 is preferably connected to the second housing portion 24 by a pivotal connection member 26 that allows the first and second housing portions, 22 and 24, to freely pivot with respect to one another. The exemplary embodiment of the housing 20 is generally formed of a hollow shell having various internal structural ribs 21 therein that provide added strength to the housing 20. The first housing portion 22 has an interior surface 28 and the second housing portion 24 has an interior surface 30. The interior surfaces 28 and 30 define an interior cavity within the housing 20 that provides a space to house the locking mechanism 40, the blade storage area 70, and the blade carriage mechanism 80. The housing 20 of the exemplary embodiment is made of a rigid plastic material, although alternatively other rigid materials may be used.

The first housing portion 22 and the second housing portion 24 each generally provide a half of the housing 20, and are configured to provide complementary shapes that form a generally symmetrical exterior shape along a plane of the blade 12. Several exceptions to these general rules are clearly evident in the exemplary embodiment. For example, an actuator 100 is position in an asymmetrical manner by offsetting the actuator 100 to one side of the top of the housing 20 in order to provide an ergonomically efficient configuration by placing the actuator 100 in a position where the user's thumb would naturally tend to be located when the user is comfortably grasping the housing 20. Therefore, the actuator 100 and its various associated components are not symmetrically positioned along the axis of the housing 20. Additionally, the locking mechanism includes an actuator portion 62 that extends through an opening 60 on the first housing portion 22.

The first housing portion 22 has an outer coating 25 and the second housing portion 28 has an outer coating 29. The outer coatings 25 and 29 are preferably made of an elastomeric material that is pliant, such as, without limitation, SANTOPRENE™, which is overmolded onto the outer surface of the first and second housing portions, 24 and 28, respectively. The housing 20 is configured to provide an ergonomically efficient contour including terminal ends 37 and 39 that have cross-sectional areas that are smaller than the cross-sectional area of a center "belly" portion 38. This ergonomically efficient shape allows the user to comfortably place the palm of their hand on the belly portion 38 of the housing 20 and wrap their fingers about the belly portion 38. The rounded shape of terminal end 37 will prevent the user's hand from feeling discomfort if the user's hand is positioned over the terminal end 37 during use of the handle 10. In addition to the ergonomic aspects of the handle 10, the handle 10 is advantageously configured to allow the handle 10 to be comfortably gripped by a large number of hands having a wide variety of sizes and shapes. The shape of the handle 10 is configured to conform to the natural contours of the human hand, specifically the narrow and oval front and rear ends 37 and 39, and the larger, circular center belly 38.

The first housing portion 22 and the second housing portion 24 have blade opening regions, 32 and 34, respectively, that form the blade opening for the handle 10. The upper side of the housing 20 has a tactile region 36 on the terminal end 39 thereof adjacent the blade opening that provides the user with a tactile indication of the end of the handle in order to prevent the user from accidentally contacting the blade 12. The tactile region 36 is located on both the first housing portion 22 and the second housing portion 24.

Referring to FIGS. 1, 3A, 3B, 4A, 4B, and 6, the utility knife handle 10 includes a locking mechanism 40 that is generally housed within the interior cavity defined by the housing 20 and includes portions on both the first housing portion 22 and the second housing portion 24. The locking mechanism includes a biased locking member 42 movably disposed on the first housing portion 22. The locking member 42 includes an elongated body 43 having a channel 44 extending longitudinally thereon. The first housing portion 22 includes at least one projection extending rigidly therefrom, with the exemplary embodiment having two projections 50. The projections 50 being movably connected to the channel 44 of the elongated body 43 such that the body 43 can slide in relation to the projections 50. The body 43 has an end 49 that is configured to slide through an opening 60 in the first housing portion 22. The end 49 has an actuator portion 62 that in the exemplary embodiment is adapted to sit flush with and adjacent to the outer surface of the coating 29 on the first housing portion 22 when the handle 10 is in a closed position. The actuator portion 62 includes an indented surface 64 that is configured to allow a user to insert a finger against the indented surface 64 and force the locking member 42 rearward such that the end 49 protrudes through opening 60 into an open position.

Figure 3A:
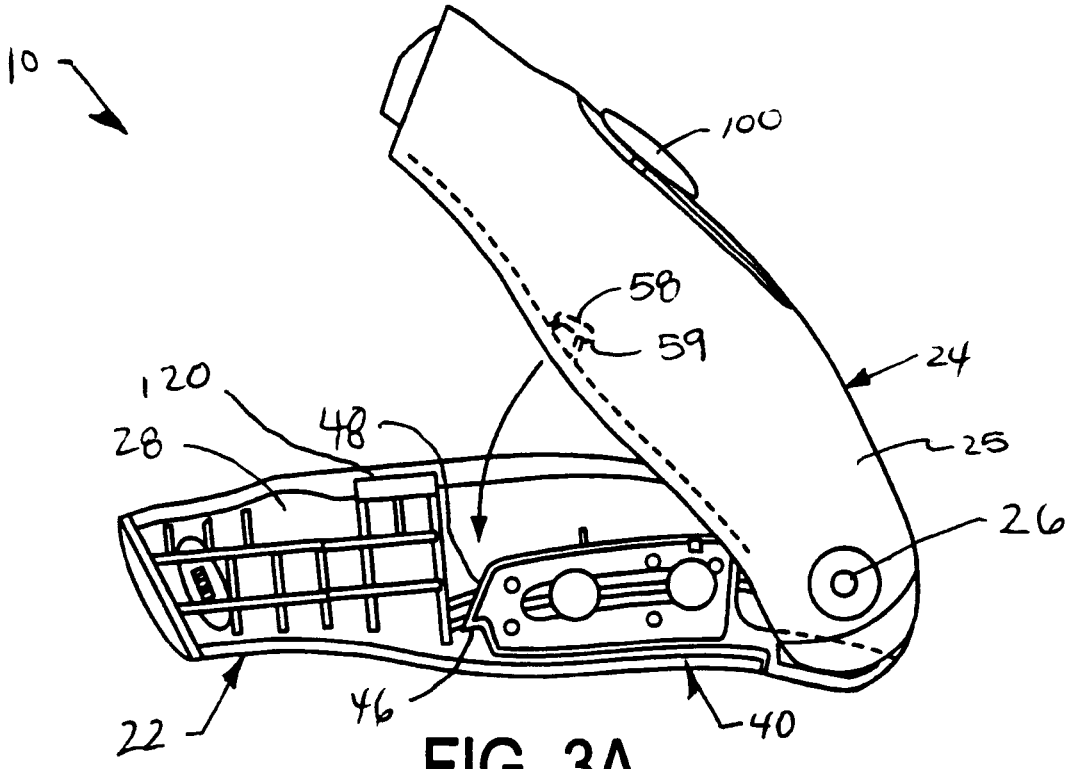
FIG. 3A is a right side view of an exemplary embodiment of a utility knife handle according to the present invention with the handle in the open position revealing the locking mechanism partially in phantom lines.
Figure 3B:
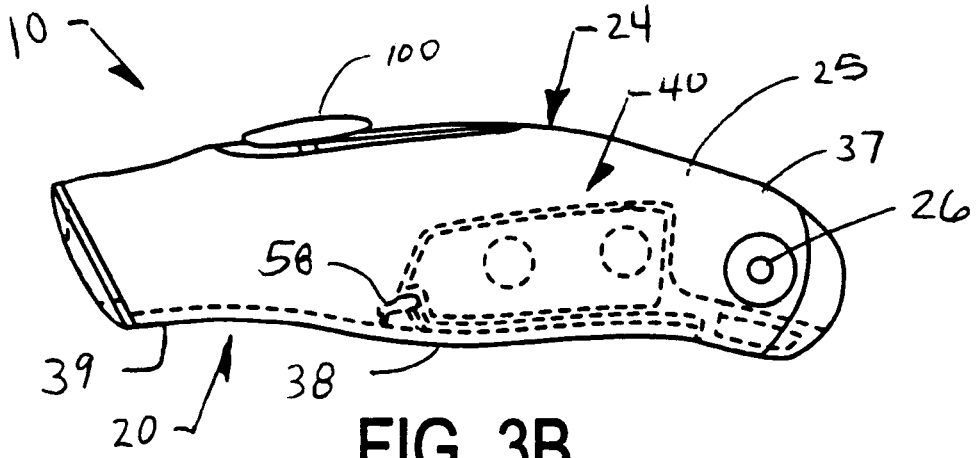
FIG. 3B is a right side view of an exemplary embodiment of a utility knife handle according to the present invention with the handle in a closed position revealing the locking mechanism in phantom lines.
Figure 4A:
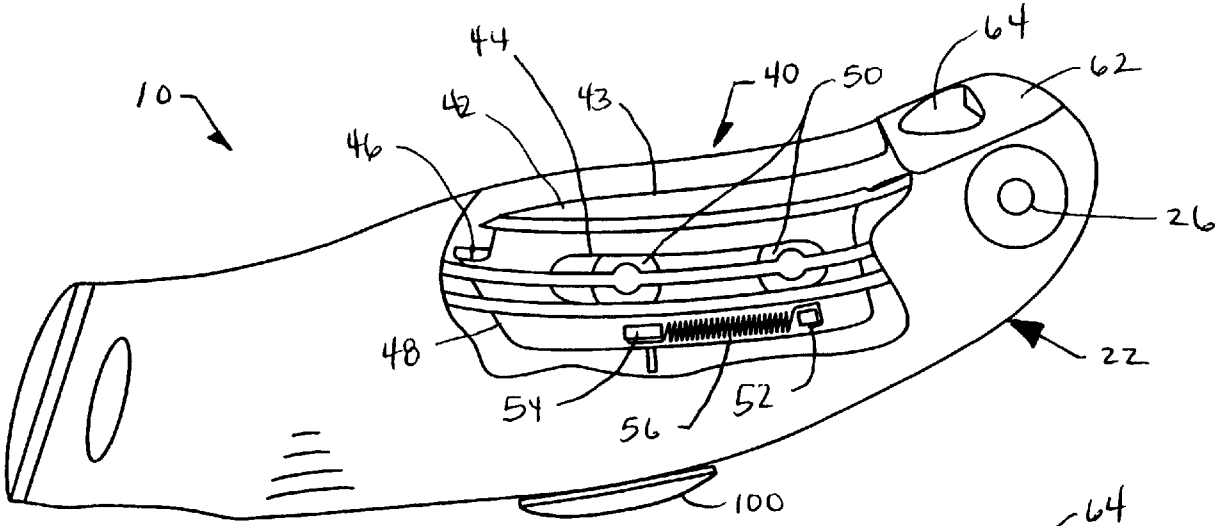
FIG. 4A is a left side view of the exemplary embodiment of a utility knife handle with a portion cut away revealing the locking mechanism in an engaged position.
Figure 4B:
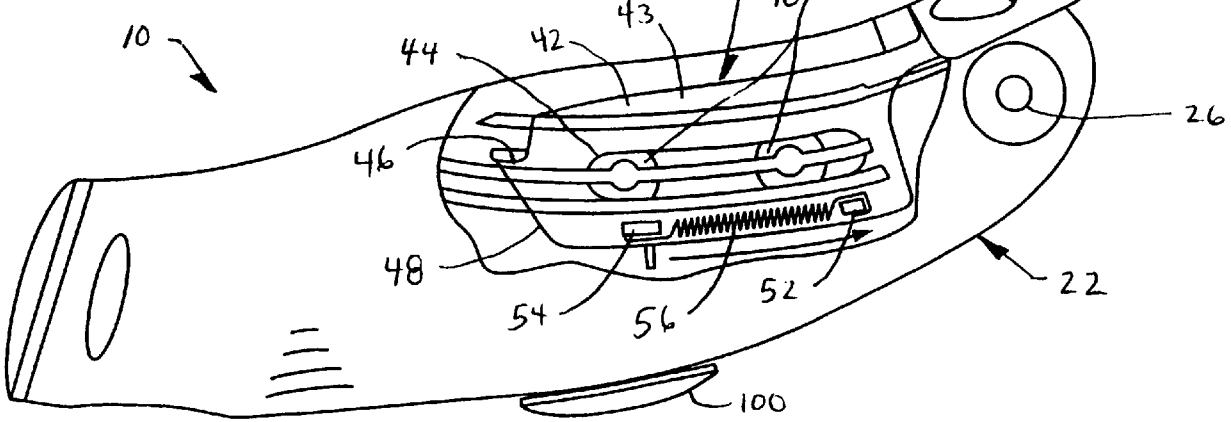
FIG. 4B is a left side view of the exemplary embodiment of a utility knife handle with a portion cut away revealing the locking mechanism in a disengaged position.

The locking member 42 further includes an inclined surface 48 on an end opposite from end 49, and a recessed surface 46 adjacent the inclined surface 48. The locking mechanism is in an engaged position and the handle 10 is in the closed position when the recessed surface 46 is engaged to an engagement member 58 rigidly mounted on the second housing portion 24, as depicted in FIG. 4A. The locking mechanism is in a disengaged position when the locking member 42 is rearwardly slid such that the recessed surface 46 is disengaged to the engagement member 58, as depicted in FIG. 4B. The locking member 42 is generally movable in a linear direction. The locking mechanism 40 further includes a tension spring 56 that has one end attached to the body 43 of the locking member 42 at point 52 and one end attached to the interior surface 28 of the first housing portion 22 at point 54. The spring 56 biases the locking member 42 into the position depicted in FIG. 4A where the locking member 42 is in a forward position and the recessed surface 46 is engaged to the engagement member 58. In order to disengage the engagement member 58 from the recessed surface 46 and thereby allow the handle 10 to be rotated about pivotal connection member 26, the user must insert a finger against the indented surface 64 and force the locking member 42 rearward such that the end 49 protrudes through opening 60 into an open position. Once the locking member 42 is slid rearward, the user can rotate the second housing portion 24 to a position as depicted in FIG. 3A. To close the handle 10, the user simply rotates the second housing portion 24 in a direction as indicated by an arrow in FIG. 3A towards the closed position, depicted in FIG. 3B. As the second housing portion 24 rotates towards the closed position a rounded contact surface 59 of the engagement member 58 contacts the inclined surface 48 of the locking member 42, whereby the locking member 42 is rearwardly forced by the contact surface 59 until the engagement member 58 passes the inclined surface 48 and comes to rest in the recessed surface 46, as depicted in FIG. 3B.

Note that the first housing portion 22 includes a groove 120 that receives a lip 122 on the second housing portion 24 when the handle 10 is in the closed position in order to prevent the first and second housing portions, 22 and 24, from rotating beyond the closed position.

Referring to FIGS. 2A, 2B, 5A, 5B, and 6, the internal cavity of the handle 10 further houses the blade storage area 70 that is configured to receive one or more blades 14 within the housing 20. The interior surface 30 of the second housing portion 24 includes a blade storage portion is defined by a plurality of walls 74 configured to conform generally to an outer perimeter of the stored blades 14. The plurality of walls 74 in the exemplary embodiment are configured to hold a blade 14 that has a trapezoidal shape. Alternatively, the plurality of walls 74 can be configured to hold differently shaped blades in alternative embodiments of the present invention as is readily apparent to one skilled in the art. The blade storage area 70 also includes the interior surface 28 of the first housing portion 22, which helps to defined the blade storage portion and helps hold the blades 14 in position therein when the handle 10 is in the closed position. The magnet 72 is selected such that it can provide sufficient magnetic forces to hold one or more blades 14 securely within the blade storage area 70. The blade storage portion has a magnet 72 mounted therein to the second housing portion 24 that holds the blades 14 within the blade storage area 70. Note that the magnet 72 is recessed compared to the plurality of walls 74, thereby providing a recessed portion for storing the blades 14.

Referring to FIGS. 2A, 2B, 5A, 5B, and 6, the internal cavity of the handle 10 further houses the blade carriage mechanism 80. The blade carriage mechanism 80 includes a blade carriage 82 movably mounted to the interior surface 30 of the second housing portion 24. The blade carriage 82 has a channel 84 extending longitudinally thereon and includes a recessed blade seat or blade receiving portion 90 that is configured, in the exemplary embodiment, to hold a blade 12 that has a trapezoidal shape. Alternatively, the blade seat 90 can be configured to hold other shaped blades in alternative embodiments of the present invention as is readily apparent to one skilled in the art. The blade seat 90 of the exemplary embodiment further includes two bumps 92 that mate with notches 13 on the blade 12 that further prevent the blade 12 from sliding on the blade carriage 82, and a lip 94 that defines a slot that holds the edge of the blade 12. The interior surface 30 of the second housing portion 24 includes at least one projection 86 extending therefrom. The projection 86 is slidably received within the channel 84 on the blade carriage 82 and works in conjunction with a track 88 on the interior surface 30 of the second housing portion 24 to allow the blade carriage 82 to slide within the handle 10. The blade carriage 82 is configured to slide between a retracted position, depicted in FIG. 5A, and an extended position, depicted in FIG. 5B. Therefore, the blade carriage 82 has an extended position whereby a blade 12 seated within the blade seat 90 extends through the blade opening, 32 and 34, and a retracted position whereby the blade 12 is positioned within the interior cavity of the housing 20. Preferably, the blade carriage 82 is mounted to the housing 20 such that the blade cartridge 82 is linearly adjustable.

The blade carriage mechanism 80 further includes an actuator 100 mounted to the blade carriage 82 by a shaft 105 that is slidably received by the blade carriage 82 such that the shaft 105 can slide in a direction along an axis of the shaft 105. The shaft 105 extends through a slot 108 at the top of the second housing portion 24 with the actuator 100 being attached to the terminal end of the shaft 105. The actuator 100 is positioned within a recessed portion 106 on the exterior surface of the second housing portion 24, which extends around the slot 108. The actuator 100 preferably has an outer coating 101 that is preferably made of an elastomeric material that is pliant, such as, without limitation, SANTOPRENE™, which is overmolded thereon. Note that the actuator 100 is offset to one side of the top of the housing 20 in order to provide an ergonomically efficient configuration by placing the actuator 100 in a position where the user's thumb would naturally tend to be located when the user is comfortably grasping the housing 20. Note that the configuration of the handle 10 can be constructed as a mirror image of the exemplary embodiment in order to produce a handle 10 and actuator 100 that are configured for ergonomically efficient use with the left hand.

Figure 5A:
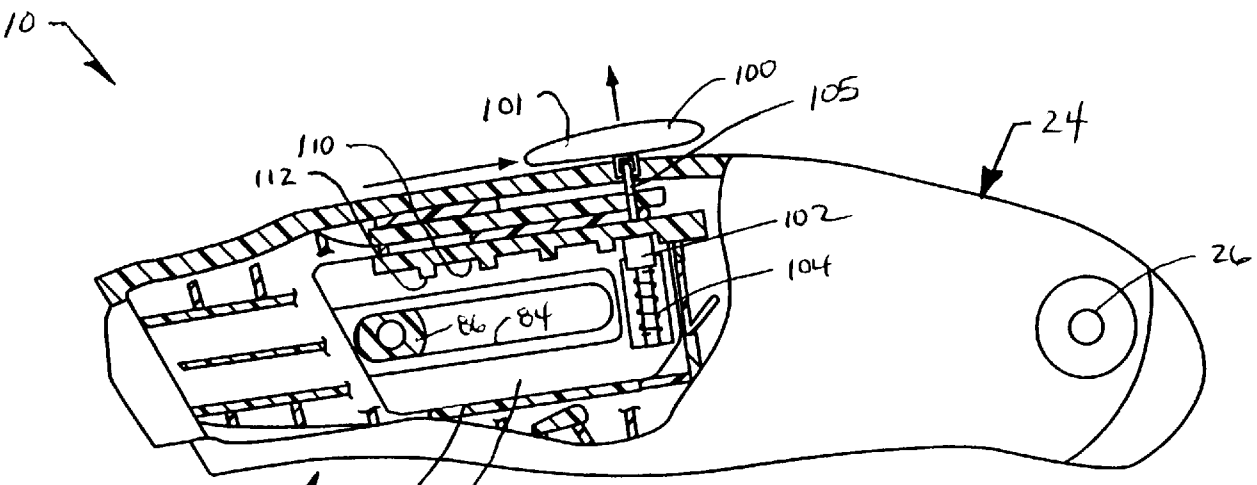
FIG. 5A is a right side view of the exemplary embodiment of a utility knife handle with a portion cut away revealing the blade carriage mechanism in a fully retracted position.
Figure 5B:
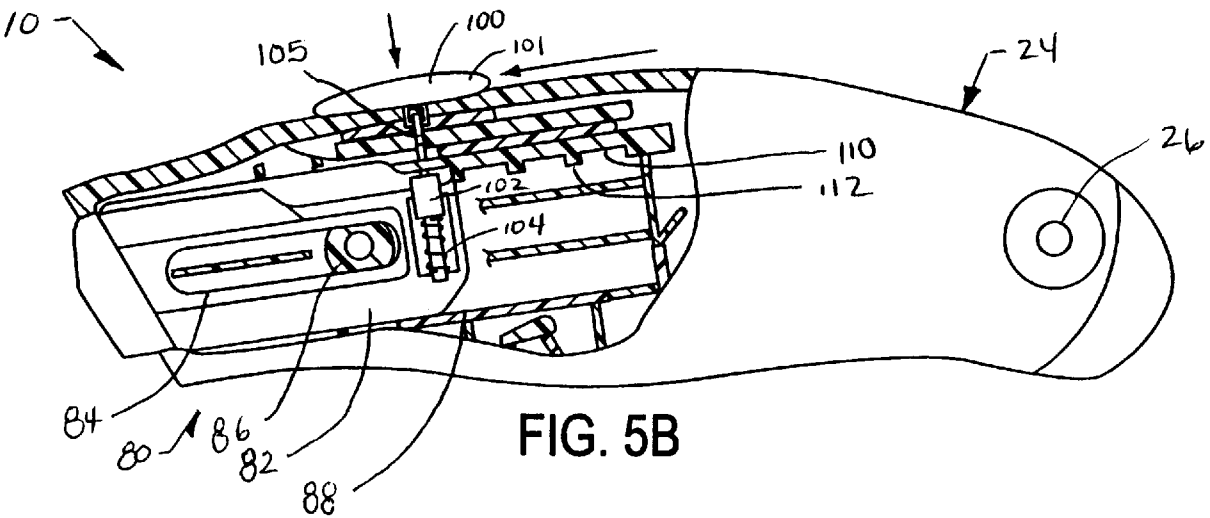
FIG. 5B is a right side view of the exemplary embodiment of a utility knife handle with a portion cut away revealing the blade carriage mechanism in a fully extended position.
Figure 6:
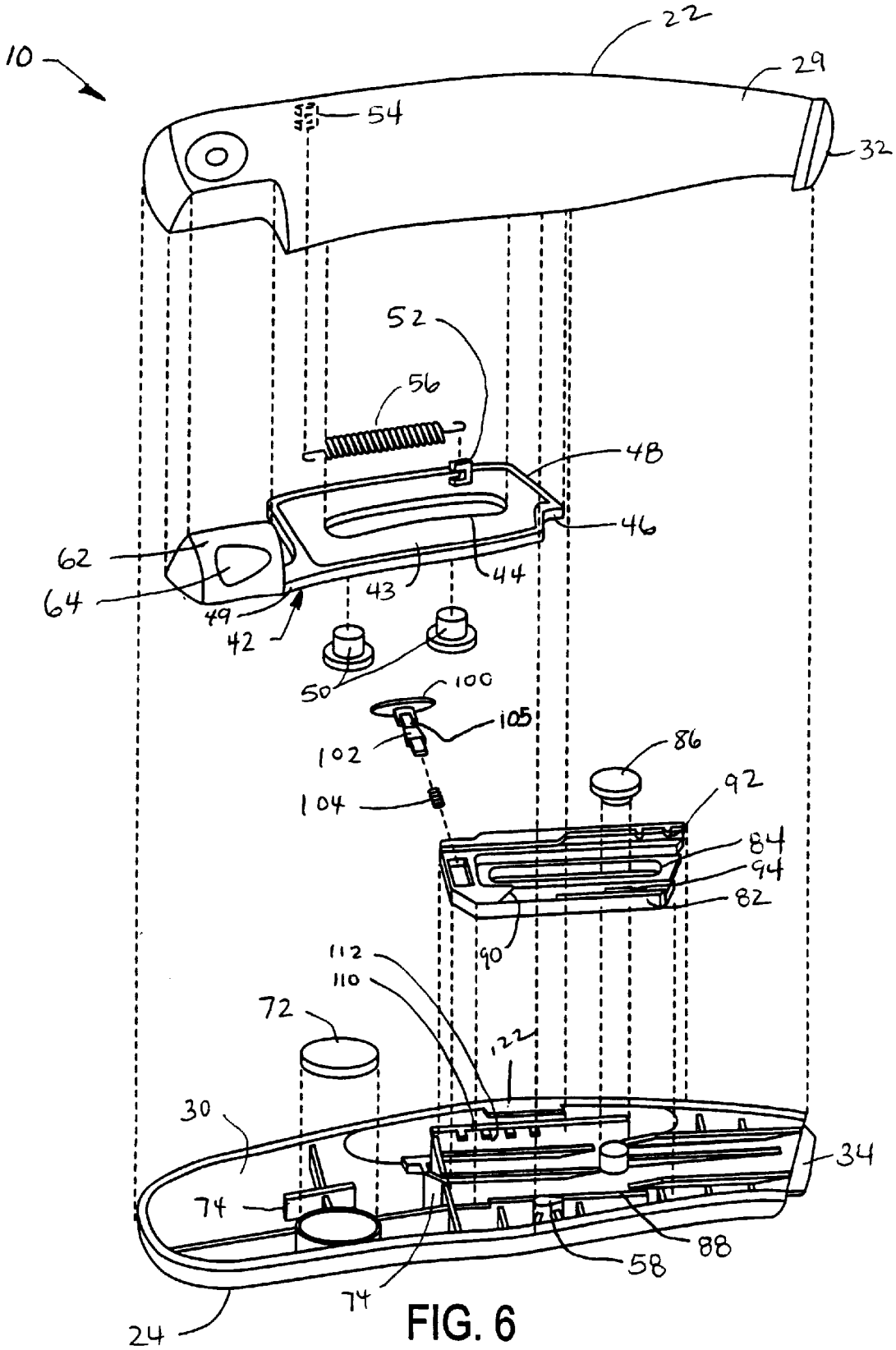
FIG. 6 is an exploded perspective view of the exemplary embodiment of a utility knife handle according to the present invention.
Figure 7:
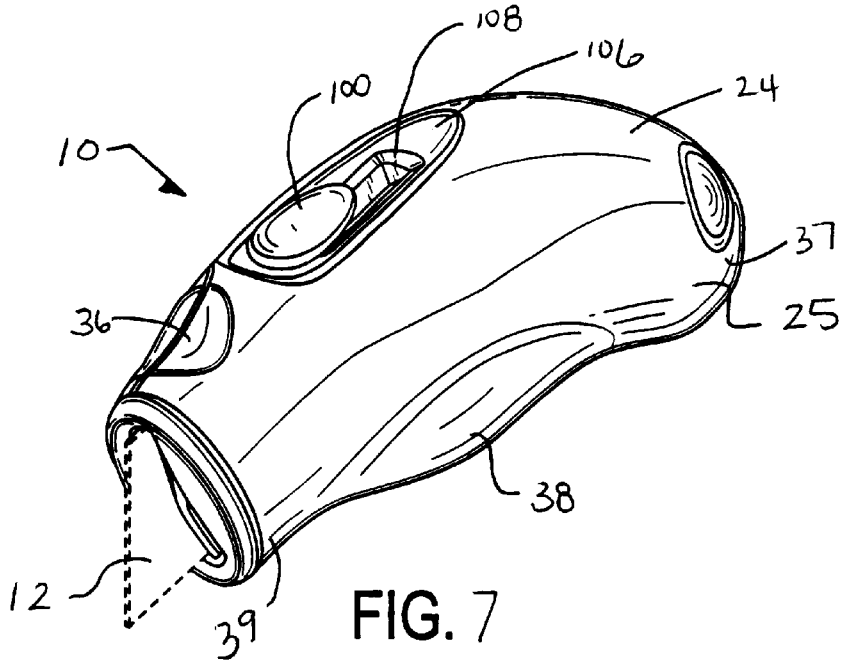
FIG. 7 is a top right perspective view of an exemplary embodiment of a utility knife handle according to the present invention.
Figure 8:
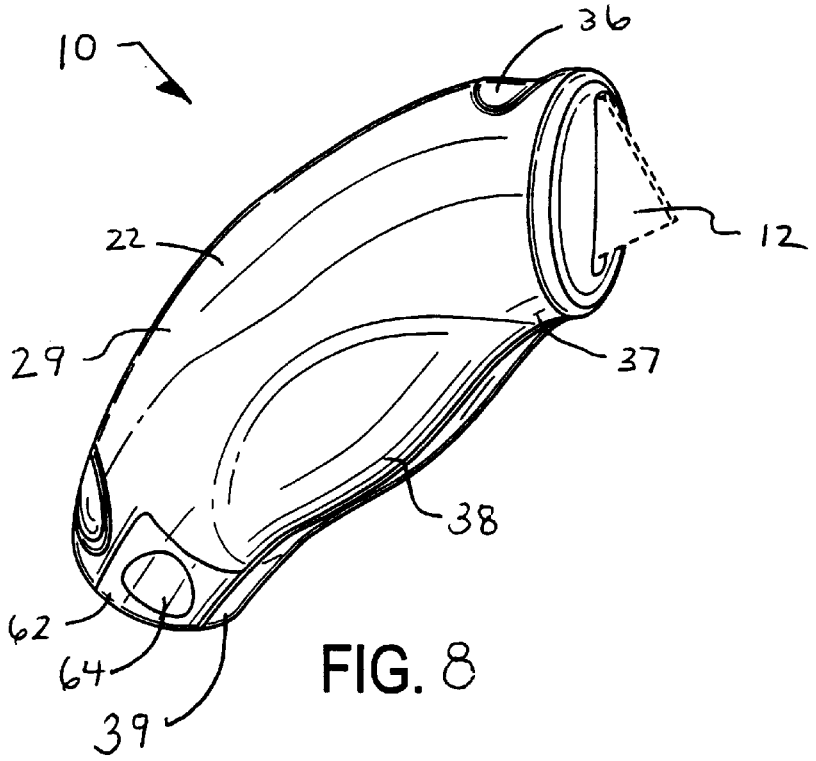
FIG. 8 is a bottom left perspective view of the exemplary embodiment of a utility knife handle according to the present invention.
Figure 9:
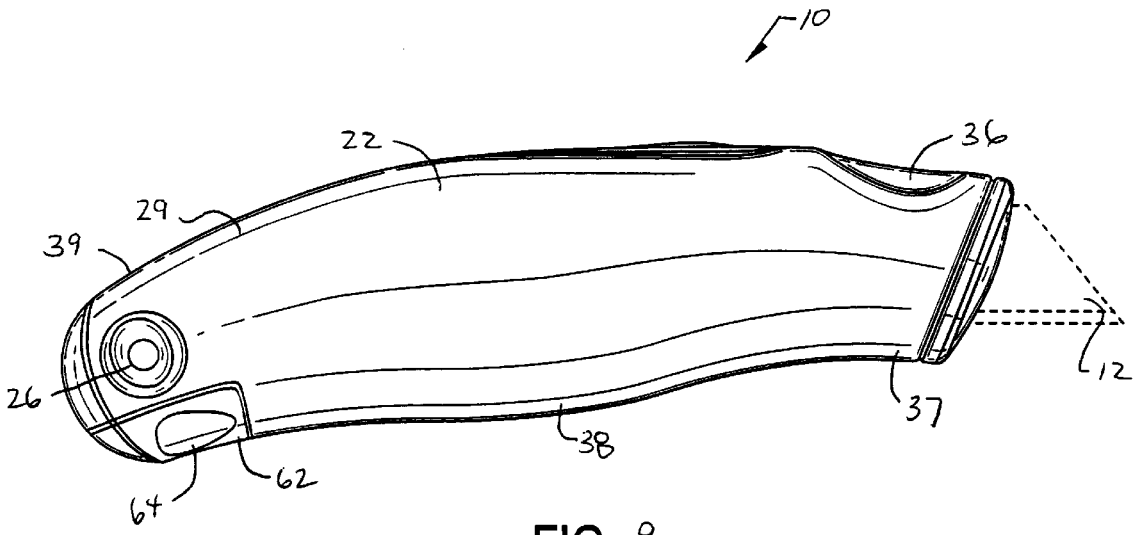
FIG. 9 is a left side view of the exemplary embodiment of a utility knife handle according to the present invention.
Figure 10:
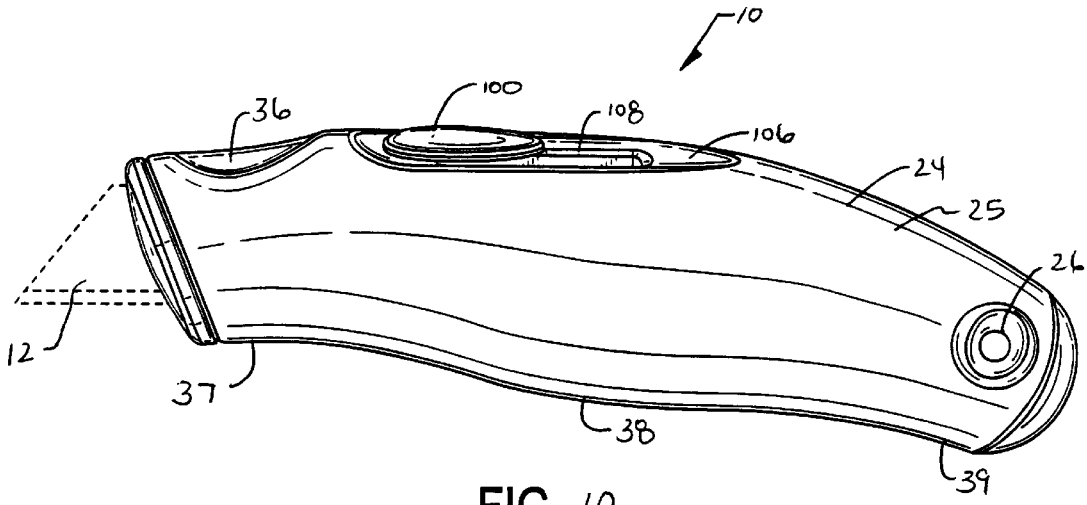
FIG. 10 is a right side view of the exemplary embodiment of a utility knife handle according to the present invention.
Figure 11:
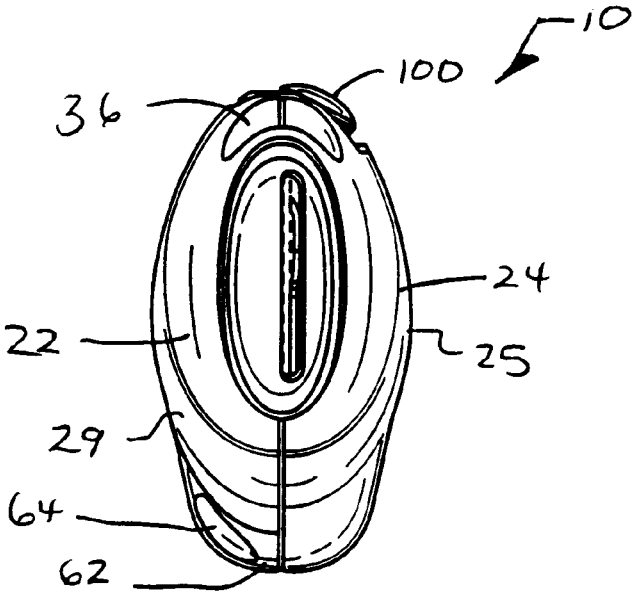
FIG. 11 is a front view of the exemplary embodiment of a utility knife handle according to the present invention.
Figure 12:
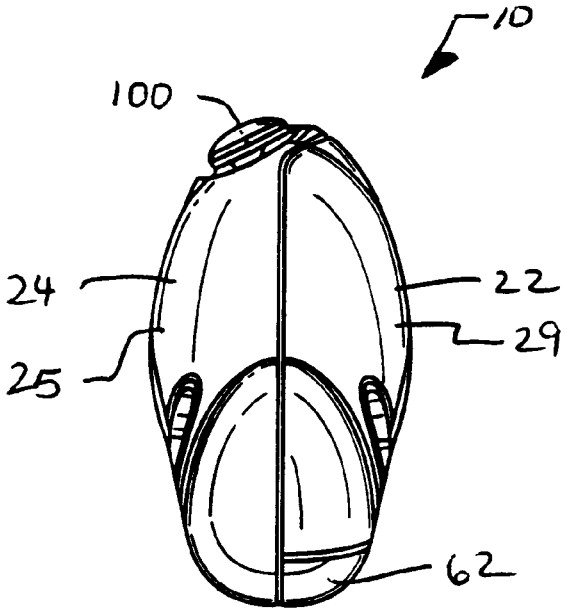
FIG. 12 is a rear view of the exemplary embodiment of a utility knife handle according to the present invention.
Figure 13:
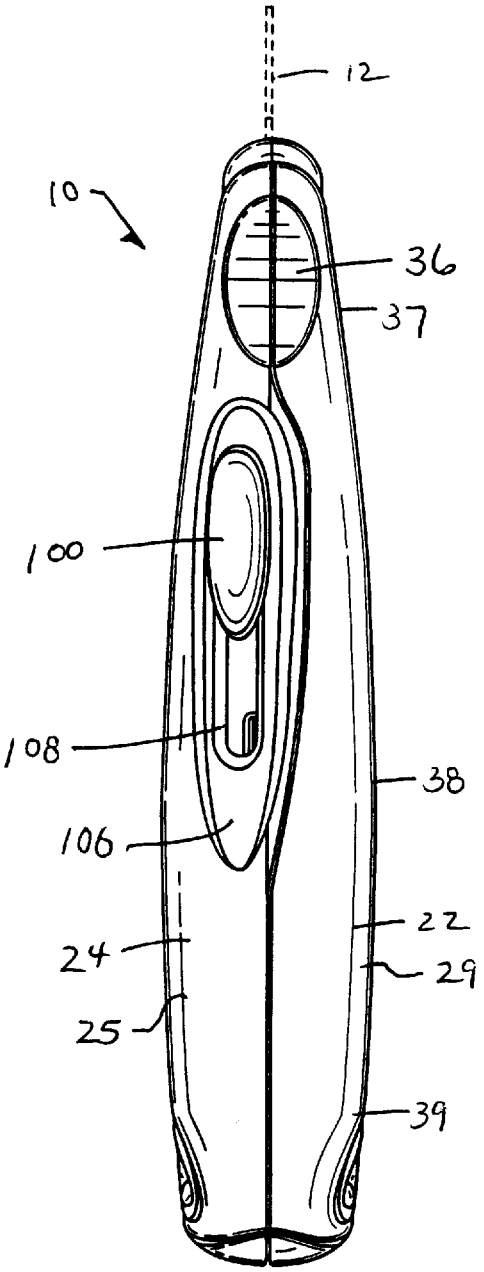
FIG. 13 is a top view of the exemplary embodiment of a utility knife handle according to the present invention.
Figure 14:
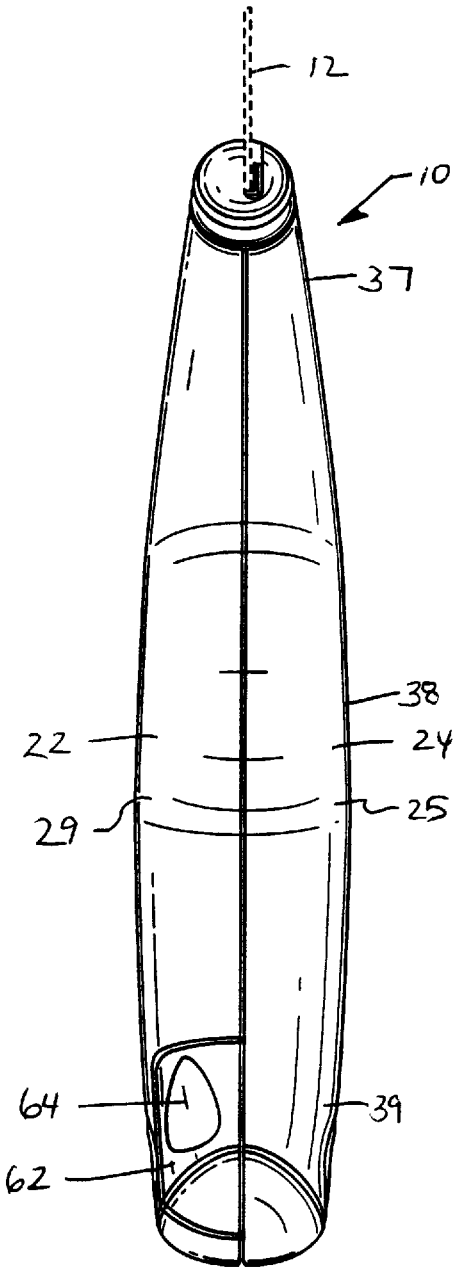
FIG. 14 is a bottom view of the exemplary embodiment of a utility knife handle according to the present invention.

The shaft 105 of the actuator 100 includes an engagement portion 102 that is fixed in a position along the shaft 105. A compression spring 104 is positioned about the bottom of the shaft 105 between the engagement portion 102 and the blade carriage 82 such that the spring 104 upwardly forces the engagement portion 102, and consequently the shaft 105 and the actuator 100. The second housing portion 24 includes a plurality of recesses 110 defined by a series of protrusions 112 that are oriented adjacent and in parallel to the top portion of the track 88. The plurality of recesses 110 are each adapted to receive the engagement portion 102 of the actuator 100, thereby preventing the blade carriage 82 from sliding along the track 88 due to the interference between the engagement portion 102 and the protrusions 112. The spring 104 biases the engagement portion 102 upwards and within one of the plurality of recesses 110, thereby mechanically biasing the actuator 100 towards a locked position. The user can push down on the actuator 100 in order to overcome the force of the spring 104 and disengage the engagement portion 102 from the plurality of recesses 110, thereby placing the actuator 100 in an unlocked position and allowing the blade carriage 82 to freely slide along the track 88. When the actuator 100 is depressed and the engagement portion 102 is disengaged from the plurality of recesses 110, the user can push the actuator 100 forward along the slot 108 until the blade 12 is extended by a distance desired by the user and then the actuator 100 can be released, thereby allowing the spring 104 to force the engagement member 102 within the corresponding recess 110, thereby locking the blade carriage 82 in position, as depicted in FIG. 5B. Preferably, the second housing portion 24 includes a series of recesses 110 in order to provide the blade cartridge 82 and actuator 100 with a plurality of extended and locked positions.

In the exemplary embodiment the handle is generally made of, without limitation, rigid plastic material with the projections 50, spring 56, blade carriage 82, projection 86, spring 104, and shaft 105 being made of, without limitation, metal. As discussed above, the outer coatings 25 and 29 and coating 101 are preferably made of an elastomeric material that is pliant, such as, without limitation, SANTOPRENE™. Other materials may be used in the construction of the handle 10 as is readily apparent to one of ordinary skill in the art.

Note that various alternative configurations of the features of the handle 10 are well within the scope of the claims recited below and that the exemplary embodiment discussed above is not intended to limit the scope of the claims recited herein. One alternative embodiment includes, for example, the locking member positioned on the second housing portion 24 and the engagement member positioned on the first housing portion, and similarly the blade storage area positioned on the first housing portion 22. Additionally, the blade carriage mechanism can be alternatively located on the first housing portion 22.

In the previous descriptions, numerous specific details are set forth, such as specific materials, structures, processes, etc., in order to provide a thorough understanding of the present invention. However, as one having ordinary skill in the art would recognize, the present invention can be practiced without resorting to the details specifically set forth. In other instances, well known processing structures have not been described in detail in order not to unnecessarily obscure the present invention.

Only the preferred embodiment of the invention and an example of its versatility are shown and described in the present disclosure. It is to be understood that the invention is capable of use in various other combinations and environments and is capable of changes or modifications within the scope of the inventive concept as expressed herein.

What is claimed is:

1. A utility knife handle comprising:

a first housing portion having a biased locking member movably disposed thereon, said locking member including an elongated body having a channel extending longitudinally thereon, said first housing portion including at least one projection extending therefrom, said at least one projection being movably connected to said channel of said elongated body; and a second housing portion pivotally joined to said first housing portion, said second housing having an engagement member, wherein said utility knife handle is in an open position when said locking member and said engagement member are disengaged and a closed position when said locking member and said engagement member are engaged.

2. The utility knife handle according to claim 1, wherein said locking member is located within a cavity defined by an interior surface of said first housing portion and an interior surface of said second housing portion.

3. The utility knife handle according to claim 1, wherein said locking member includes a recess for engaging said engagement member when said utility knife handle is in the closed position and an inclined surface configured to contact said engagement member and guide said engagement member to said recess when said utility knife handle is moved from the open position to the closed position.

4. The utility knife handle according to claim 1, wherein said locking member has an actuator portion that is exterior to said first housing portion and is located adjacent an exterior surface of said utility knife handle.

5. The utility knife handle according to claim 4, wherein said actuator portion includes an indented surface.

6. The utility knife handle according to claim 1, wherein said locking member is movable in a linear direction and said engagement member is rigidly fixed to said second housing portion.

7. The utility knife handle according to claim 1, wherein said locking member is further connected to said first housing portion by a spring.

8. The utility knife handle according to claim 7, wherein said spring biases said locking member into engagement with said engagement member.

9. The utility knife handle according to claim 1, wherein said first housing portion and said second housing portion have ergonomic exterior surfaces configured to provide a central portion of said utility knife handle with a larger cross-sectional area than a cross-sectional area of terminal end portions of said utility knife.

10. The utility knife handle according to claim 1, wherein said first housing portion and said second housing portion each have an outer coating made of an elastomeric material.

11. The utility knife handle according to claim 1, further comprising a blade carriage movably mounted to said second housing portion, said blade carriage having a channel extending longitudinally thereon, said second housing portion including at least one projection extending therefrom, said at least one projection being movably connected to said channel of said blade carriage, said blade carriage having a blade receiving portion, said blade carriage including an actuator mounted to said blade carriage and having a locked position whereby said actuator is engaged to said second housing portion thereby preventing said blade carriage from moving with respect to said second housing portion and an unlocked position whereby said actuator is disengaged to said second housing portion thereby allowing said blade carriage to move with respect to said second housing portion.

12. The utility knife handle according to claim 1, wherein:

said first housing portion has a first interior surface;

said second housing portion is connected to said first housing portion, said second housing portion having a second interior surface, said first interior surface and said second interior surface defining an interior cavity; and said first interior surface has a blade storage portion configured to receive at least one blade, said blade storage portion having a magnet therein for retaining the at least one blade within said blade storage portion.

13. A utility knife handle comprising:

a housing having an interior surface defining an interior cavity and a blade opening;

a blade carriage movably mounted to said housing within the interior cavity, said blade carriage having a channel extending longitudinally thereon, said interior surface of said housing including at least one projection extending therefrom, said at least one projection being movably connected to said channel of said blade carriage, said blade carriage having a blade receiving portion, said blade carriage having an extended position whereby a blade seated within said blade receiving portion extends through said blade opening and a retracted position whereby the blade is positioned within the interior cavity, said blade carriage including an actuator mounted to said blade carriage and having a locked position whereby said actuator is engaged to said housing thereby preventing said blade carriage from moving with respect to said housing and an unlocked position whereby said actuator is disengaged to said housing thereby allowing said blade carriage to move between the extended position and the retracted position.

14. The utility knife handle according to claim 13, wherein said actuator is mechanically biased towards the locked position by a spring.

15. The utility knife handle according to claim 13, wherein said actuator includes a protruding member and said housing includes a recess on said interior surface, said protruding member being seated within said recess when said actuator is in the locked position and said protruding member being disengaged from said recess when said actuator is in the unlocked position.

16. The utility knife handle according to claim 15, wherein said housing includes a plurality of recesses with each recess being adapted to receive said actuator in a locked position to provide said blade carriage with a plurality of extended positions.

17. The utility knife handle according to claim 13, wherein said actuator is positioned offset from a central axis of said utility knife handle.

18. The utility knife handle according to claim 13, wherein said actuator has a button attached to a terminal end thereof, said button being positioned exterior of said housing.

19. The utility knife handle according to claim 13, wherein said blade carriage is mounted to said housing such that said blade cartridge is linearly adjustable.

20. The utility knife handle according to claim 13, wherein said housing has an exterior surface having an indentation proximate to said blade opening for providing a tactile cue to a user of said blade opening.

21. The utility knife handle according to claim 13, wherein said housing has an outer coating made of an elastomeric material and wherein said actuator has a portion having an outer coating made of an elastomeric material.

22. The utility knife handle according to claim 12, wherein said blade storage portion is defined by a plurality of walls configured to conform to an outer perimeter of the at least one blade.

23. The utility knife handle according to claim 12, wherein said blade storage portion includes a recessed portion having said magnet positioned therein.

24. The utility knife handle according to claim 13, wherein said interior surface of said housing has a blade storage portion configured to receive at least one blade, said blade storage portion having a magnet therein for retaining the at least one blade within said blade storage portion.

25. The utility knife handle according to claim 13, wherein said blade storage portion is defined by a plurality of walls configured to conform to an outer perimeter of the at least one blade.

26. The utility knife handle according to claim 13, wherein said blade storage portion includes a recessed portion having said magnet positioned therein.

* * * * *